US011045817B2

(12) United States Patent
Costello

(10) Patent No.: US 11,045,817 B2
(45) Date of Patent: Jun. 29, 2021

(54) PORTABLE ROLLING SHREDDER UNIT

(71) Applicant: Regis Costello, Tukwila, WA (US)

(72) Inventor: Regis Costello, Tukwila, WA (US)

( * ) Notice: Subject to any disclaimer, the term of this patent is extended or adjusted under 35 U.S.C. 154(b) by 0 days.

(21) Appl. No.: 16/405,834

(22) Filed: May 7, 2019

(65) Prior Publication Data

US 2019/0388901 A1 Dec. 26, 2019

Related U.S. Application Data

(63) Continuation-in-part of application No. 15/954,013, filed on Apr. 16, 2018, now abandoned.

(Continued)

(51) Int. Cl.

| | |
|---|---|
| ***B02C 21/02*** | (2006.01) |
| ***B02C 18/00*** | (2006.01) |
| ***B02C 25/00*** | (2006.01) |

(52) U.S. Cl.

CPC ..... *B02C 21/02* (2013.01); *B02C 18/0007* (2013.01); *B02C 25/00* (2013.01); *B02C 2018/0046* (2013.01); *B02C 2201/06* (2013.01)

(58) Field of Classification Search

CPC ..... B02C 18/0007; B02C 2018/0038; B02C 2018/0046; B02C 21/02; B02C 25/00

See application file for complete search history.

(56) References Cited

U.S. PATENT DOCUMENTS 7,195,185 B2 * 3/2007 Matlin ..... A61L 11/00 241/100

8,925,841 B2 * 1/2015 Jensen ..... B02C 25/00 241/36

(Continued)

*Primary Examiner* — Faye Francis

(74) *Attorney, Agent, or Firm* — Evan Law Group LLC

(57) ABSTRACT

A portable shredder unit includes a lightweight housing with an interior cavity divided into a battery storage cavity and a collection cavity, said housing includes a top opening, two opposite ends, two opposite side walls, and a floor; a removable lid attached to said top opening on said housing; a high capacity electric shredder component configured to shred paper, said shredder component includes at least one feeding slot opening, an electric shredding mechanism, and electric motor and an exit discharge opening said shredder component being oriented on said lid so that said feeding slot opening is exposed when the lid is placed over the top opening of said housing and said exit discharge opening is oriented above and over said collection cavity in said housing so that shredded material exiting the exit discharge opening is deposited into said collection cavity; at least one pair of wheels attached to said housing near one said end; a handle attached to said housing; a GFCI receptacle having a ground wire; a 110 VAC main cable with a male electrical plug attached to one end configured to manually plug into an external 110 VAC female plug, and an opposite end being connected to said GFCI receptacle; at least one 12 VDC rechargeable battery located inside said battery storage cavity; an inverter configured to convert 12 VDC into 110 VAC, said inverter connected to said rechargeable battery to convert 12 VDC current into 110 VAC, said inverter; a control panel or set of switches electrically connected to said shredder, to said inverter and to said GFCI receptacle, said control panel or set of switches are configured to allow an operator to select the source of electricity either from said GFCI receptacle when said main cable is connected to an external 110 VAC female plug or from said inverter when connected to said rechargeable battery; and a ground roller ball attached to the floor of the housing and configured to contact a surface under the housing when the portable shredding unit is placed onto the surface said ground roller ball electrically connected to the ground wire of said GFCI receptacle.

20 Claims, 19 Drawing Sheets

Related U.S. Application Data

(60) Provisional application No. 62/465,733, filed on Apr. 14, 2017.

(56) References Cited

U.S. PATENT DOCUMENTS

2005/0279869 A1* 12/2005 Barklage ..... B02C 18/0007 241/100
2006/0091247 A1* 5/2006 Matlin ..... B02C 18/0007 241/36
2007/0034723 A1* 2/2007 Joachim ..... B65F 1/0053 241/100
2009/0026294 A1* 1/2009 Abramson ..... B02C 23/04 241/36
2010/0308139 A1* 12/2010 Abramson ..... B02C 23/04 241/25
2011/0042494 A1* 2/2011 Sued ..... B02C 18/0007 241/24.3
2011/0290923 A1* 12/2011 Matlin ..... B02C 18/0007 241/30
2012/0037741 A1* 2/2012 Wu ..... B02C 18/24 241/285.1
2013/0062444 A1* 3/2013 Jensen ..... B02C 18/0007 241/30
2016/0066747 A1* 3/2016 Martin ..... A47J 43/0727 241/15
2019/0217308 A1* 7/2019 Reynolds ..... B02C 18/24

* cited by examiner

PORTABLE ROLLING SHREDDER UNIT

REFERENCE TO RELATED APPLICATIONS

This utility patent application is based on and claims the filing date benefit of Application No. 62/485,733 filed on Apr. 14, 2017, and application Ser. No. 15/954,013 filed on Apr. 16, 2018, both of which are incorporated by reference in their entirety.

Notice is given that this patent document contains original material subject to copyright protection. The copyright owner has no objection to the facsimile or digital download reproduction of all or part of the patent document, but otherwise reserves copyrights.

BACKGROUND

Retirement centers are housing complexes designed for older adults who can care for themselves but need assistance with meals, social activities and transportation. Tenants typically reside in their own 1 to 2-bedroom apartments and individually purchase telephone and cable television services. Other services, such as water, electricity gas, mail services and house cleaning services are usually provided by the retirement center employees.

Mail and packages sent to residents in the retirement center are delivered to a central post office, sorted and then placed into each resident's locked mailbox. Because the residents are older adults, the mail and packages they receive often contain retirement checks, bank statements, medical records, estate documents; or other confidential documents and must be disposed of properly. Unfortunately, older adults either do not have paper shredders or do not have the visual capabilities or memories to operate a shredder. Therefore, important confidential papers are inadvertently deposited in the trash. Shredding companies that pickup confidential papers and agree to destroy them later at a remote location are also unsatisfactory because the destruction of these papers cannot be verified by the resident.

Furthermore, there is an increased need to handle and shred polyethylene containers. Although the amount of polyethylene containers continues to increase, the demand for waste streams of recyclable containers has not, in part due to the bulk of the containers. More and more of the recyclable containers are ending up in ocean waters or landfills. Easy ways to collect and compact the containers would increase the value of the recyclable material by reducing transportation costs.

SUMMARY

In one aspect, the present invention includes a portable shredder unit includes a lightweight housing with an interior cavity divided into a battery storage cavity and a collection cavity, said housing includes a top opening, two opposite ends, two opposite side walls, and a floor; a removable lid attached to said top opening on said housing; a high capacity electric shredder component configured to shred paper, said shredder component includes at least one feeding slot opening, an electric shredding mechanism, and electric motor and an exit discharge opening said shredder component being oriented on said lid so that said feeding slot opening is exposed when the lid is placed over the top opening of said housing and said exit discharge opening is oriented above and over said collection cavity in said housing so that shredded material exiting the exit discharge opening is deposited into said collection cavity; at least one pair of wheels attached to said housing near one said end; a handle attached to said housing; a GFCI receptacle having a ground wire; a 110 VAC main cable with a male electrical plug attached to one end configured to manually plug into an external 110 VAC female plug, and an opposite end being connected to said GFCI receptacle; at least one 12 VDC rechargeable battery located inside said battery storage cavity; an inverter configured to convert 12 VDC into 110 VAC, said inverter connected to said rechargeable battery to convert 12 VDC current into 110 VAC, said inverter; a control panel or set of switches electrically connected to said shredder, to said inverter and to said GFCI receptacle, said control panel or set of switches are configured to allow an operator to select the source of electricity either from said GFCI receptacle when said main cable is connected to an external 110 VAC female plug or from said inverter when connected to said rechargeable battery; and a ground roller ball attached to the floor of the housing and configured to contact a surface under the housing when the portable shredding unit is placed onto the surface, said ground roller ball electrically connected to the ground wire of said GFCI receptacle.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
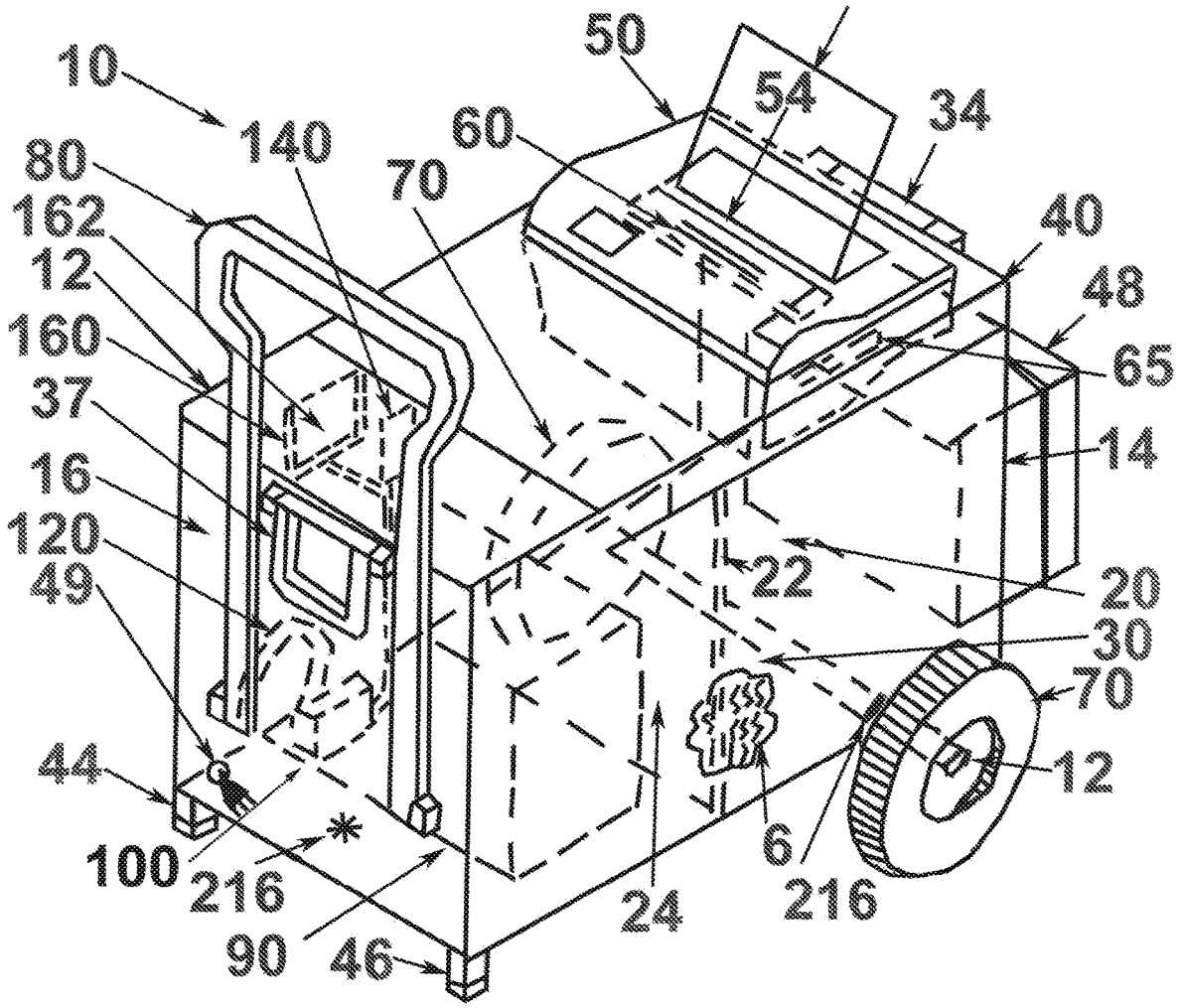
FIG. 1 is a top perspective view of a portable, rolling shredder unit.
Figure 2:
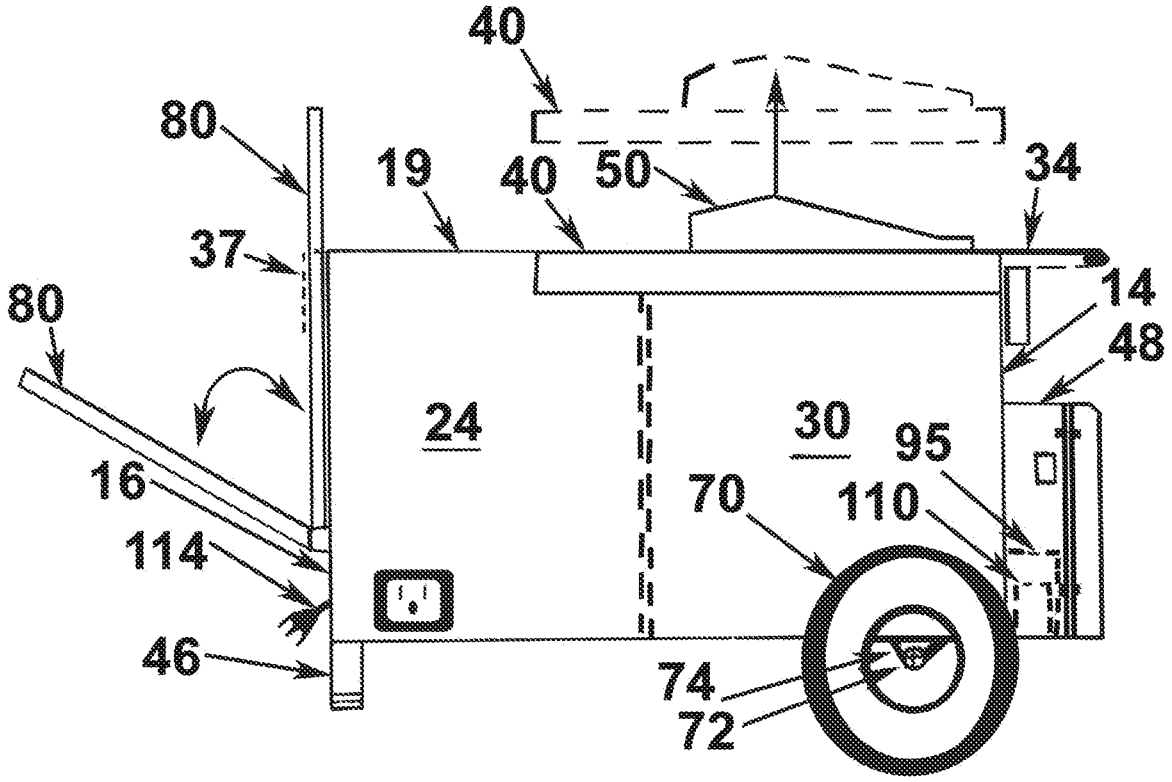
FIG. 2 is a side elevational view of the shredder unit shown in FIG. 1 showing the lid being removed from the housing and showing the elongated handle pivotally attached and rotated diagonally and used to pull the shredder unit over a flat surface.
Figure 3:
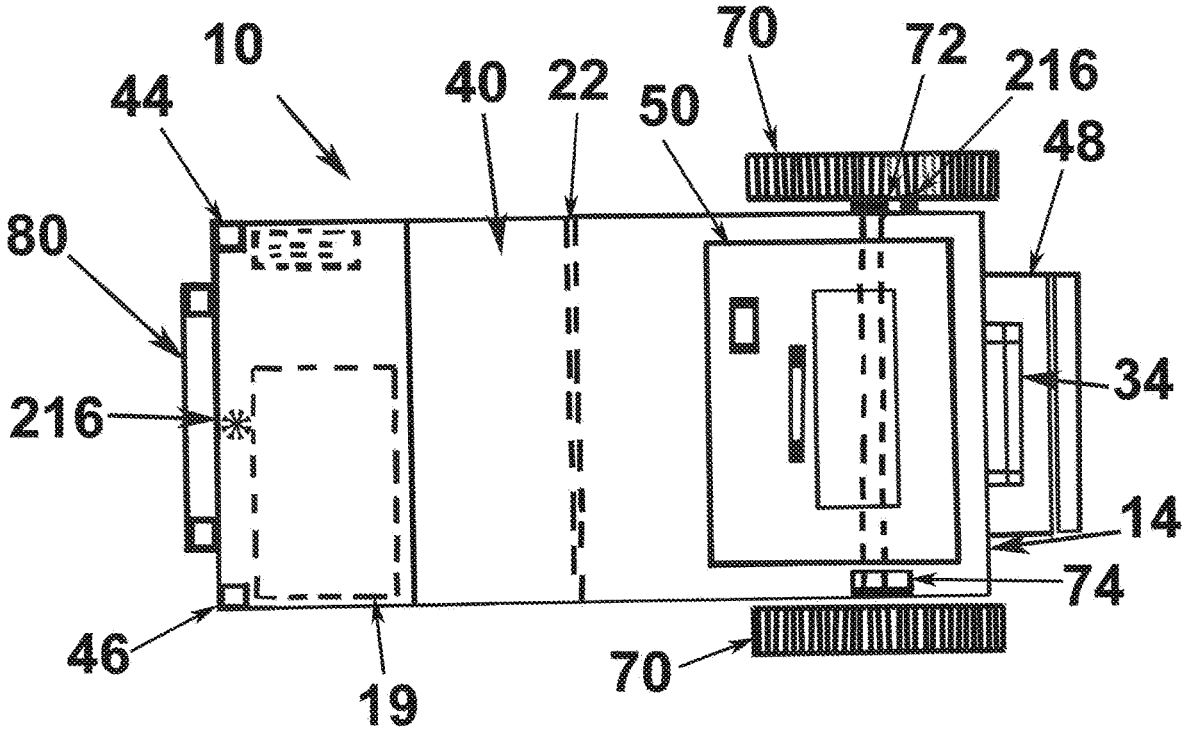
FIG. 3 is a top plan view of the shredder unit shown in FIG. 2 with the elongated handle vertically aligned in storage configuration.

What is needed is a portable shredder that can be easily transported to each individual apartment and used to shred confidential materials immediately in front of the resident. What is needed is a portable shredder that operates on either a battery or on a 110 volt electrical outlet. Furthermore, the shredder should be robust enough for transport to outdoor locations where waste polyethylene containers are found, such as beaches and landfills, and be able to compact and shred the polyethylene containers to reduce the volume for ease of transportation. Lastly, the electrical system should minimize the risks to user of undesirable electrical charge buildup due to extended use away from properly grounded municipal electricity supply.

The portable rolling shredder unit includes a lightweight housing with a large interior cavity divided into a battery storage cavity and a collection cavity. Mounted on the housing lid or located inside the housing is a high capacity electric shredder.

Located inside the battery storage cavity is a rechargeable battery. The unit is designed so the shredder may run off an external 110 VAC power source or run off a rechargeable battery. An inverter is provided that inverts the 12 VDC electric current from the battery into a 110 VAC electric current for use by the shredder. A battery charger is also provided to recharge the rechargeable battery when desired. The unit also includes a control panel with a mode switch that operator uses to control the source of electricity to the shredder and to setup the unit for battery charging.

The unit includes a long extension cord stored in an automatic rewind reel. The end of the extension cord is connected to a GFCI electrical outlet mounted on the side of the housing or inside the housing. The GFCI electrical outlet is connected to power inlet connectors on a control panel that includes a three-position mode switch that the operates manually operates to run the shredder motor from a 110 VAC power source, a 12 VDC power source or activate a recharging unit to recharge the 12 VDC battery. The control panel also includes power outlet connectors are connected to a cable that connects to the shredder.

The inverter is configured to convert 12 VDC from the rechargeable battery into 110 VAC. The inverter includes at least one female electrical outlet, an external switch, and positive and negative charging cables configured to connect to a 12-volt VDC rechargeable battery. The inverter may be hardwired directly to the control panel or it may include a power cable that manually connects to a female outlet plug on the GFCI electrical outlet.

The battery charger includes a positive and negative charging cables that connect to the rechargeable battery. The battery charger includes a power cable that manually connects to a female outlet plug on the GFCI electrical outlet.

In a first aspect, the housing 12 is smaller than the housing used on the second aspect. In the first aspect, the inverter and the battery charger are mounted in an ancillary box that attaches to the outside surface of the housing.

Each housing is mounted on at least one pair of wheels that enable the housing to be manually moved over a flat surface. Each housing also includes an elongated handle that enables the housing to be manually lifted or tilted diagonally like a two-wheel hand truck. In one aspect, the handle may be pivotally attached at one end to the housing or it may be retractable and slide into the housing or lid.

In both aspects, an optional single or dual electrical power plugin may also be mounted on the side of the housing or the lid that connects to a standard male plug on an extension cord or a second electrical appliance, such as a vacuum cleaner.

In the preferred aspect, the shredder component is mounted in the lid with its discharge shoot located over the collection cavity. An optional transversely aligned partition may be placed inside the housing to separate the battery cavity from the collection cavity. The partition is configured to prevent shredded material from falling into the battery cavity.

In one aspect, a plastic collection bin may be placed in the collection cavity to collect shredded material, in another aspect, an optional plastic bag may be expanded and hung inside the collection cavity so shredded material falls directly therein, in another aspect, the shredder component is located inside the collection cavity formed, in, the housing. An optional slot may be formed on the lid directly over the feed opening on the shredder so that paper may be fed into the shredder when the lid is closed on the housing.

A portable rolling shredder unit 10 that includes a six-sided, lightweight housing 12 with a large interior cavity 20 with an optional, transversely aligned, vertical partition 22 that divides the interior cavity 20 into a front battery storage cavity 24 and a rear collection cavity 30. Mounted over the top opening 13 of the housing 12 is a short fixed lid 19 and a moveable long lid 40. In the preferred aspect, a high capacity electric shredder component 50 with at least one exposed shredder feeding slot 54. The shredder unit 10 is mounted in the lid 40 with its discharge shoot located over the collection cavity 30 so that shredded material falls from the shredder component 50 and into the collection cavity 30. The vertical partition 22 is used to separate the battery storage cavity 24 from the collection cavity 30. In the aspect shown in the Figs, the housing 12 includes two vertical end walls 14, 16, two vertical side walls 15, 17, a flat floor 18.

Located inside the battery storage cavity 24 is a rechargeable 12 VDC battery 90. In the first aspect, an ancillary housing 48 is attached to the housing 12 that contains a battery charger 94, an inverter 100, and a control panel 160. Attached to the control panel 160 is a mode switch 162 discussed further below. Mounted on two side walls 15, 17 and near the first end 14 of the housing 12 is a pair of rear wheels 70. The wheels 70 are attached to the ends of an axle 72 that extends transversely under the floor 18 of the housing 12. U-shaped brackets 74 hold the axle 72 in place in the housing 12. Extending downward from the floor 18 near the second end 16 are a pair of vertical legs 44, 46 that elevate and support the front portion of the housing 12 on a support surface.

Attached to the two ends 14, 16 on the housing 12 are two optional handles 80 thereby allowing the unit 10 to be easily lifted and then, pushed or pulled along a flat surface. Mounted on the second end 16 of the housing 12 is an optional pivoting elongated handle 80 that enables the second end 16 to be lifted so that the housing 12 is diagonally aligned and may be rolled across a flat support surface, similar to a hand truck or luggage carrier.

The shredder component 50 includes an internal shredder mechanism 60 with an electric motor 62 configured to operate when connected to a 110 AVC electric circuit. The shredder mechanism 60 includes a feeding slot 54, a discharge opening 58, an object sensor 61 that automatically operates the motor 62 for 3 to 5 seconds with an object is detected inside the slot 54. Mounted on the top surface of the shredder component 50 is a power switch 66 and an optional power ON LED 67. The shredders electric motor 62 is connected to a mode switch 162 that controls the source of the electricity delivered to the shredder component 50 and controls battery recharging.

The rechargeable battery 90 is a 12 VDC rechargeable battery with at least one positive post 92 and one negative post 93. The positive and negative posts 92, 93 on the rechargeable battery 90 are connected to positive and negative cables 102, 103 that extend from a 12 VDC to 110 VAC power convert inverter 100. During operation, the inverter 100 automatically inverts the 12 VDC circuit to a 110 VAC circuit. The inverter 100 includes a main power switch 104, an optional LED power light 105, an optional USB charging port 106 and at least one female outlet plug 108. The inverter 100 is either directly connected (i.e. hardwired) to the control panel 160 via a direct cable 165 or is manually connected to a GFCI receptacle 140 via a dual male plug cable 150 that plugs into a female outlet plug on the GFCI electrical outlet 140.

The shredder component 50 is mounted on the removable lid 40. During use, the lid 40 is placed over the top opening 13 of the housing 12. The lid 40 with the shredder mechanism 60 are configured to be manually lifted off the housing 12 thereby exposing the collection cavity 30. Shredding material 6 deposited in the collection cavity 30 may be easily removed from the housing 12.

The shredder mechanism 60 is connected to a control panel 110 that includes an electrical source switch 112 that controls which electric source is used to provide 110 VAC current to the shredder motor 62. The control panel 110 may also include an optional battery charging switch 114 that connects to a secondary board 116 that connects the 110 VAC circuit to the control panel 110 or to a battery charger 94. Battery charging switch 114 allows the user to selectively charge the battery 90.

Figure 4:
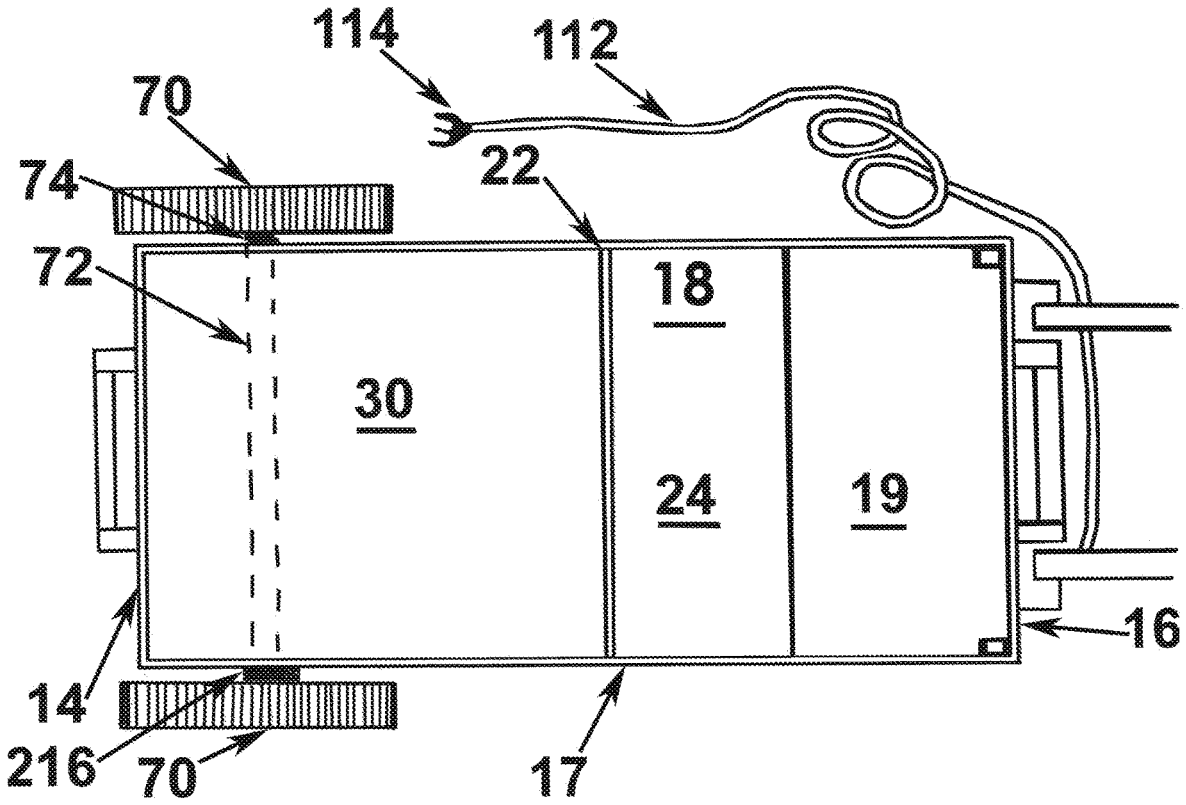
FIG. 4 is a top plan view of the shredder unit shown in FIG. 2 showing the lid removed so that shredded material may be removed from the collection cavity.
Figure 5:
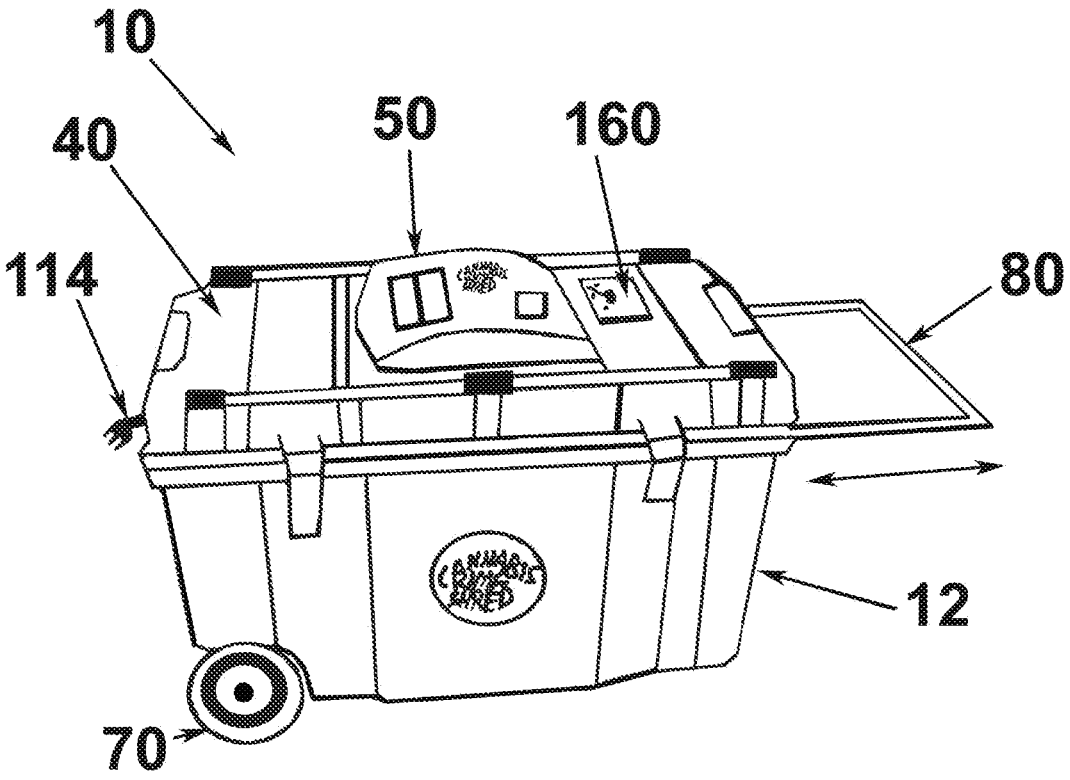
FIG. 5 is a top perspective view of a second aspect of the portable shredder unit that uses a larger housing configured to hold the inverter and includes a larger waste cavity.
Figure 6:
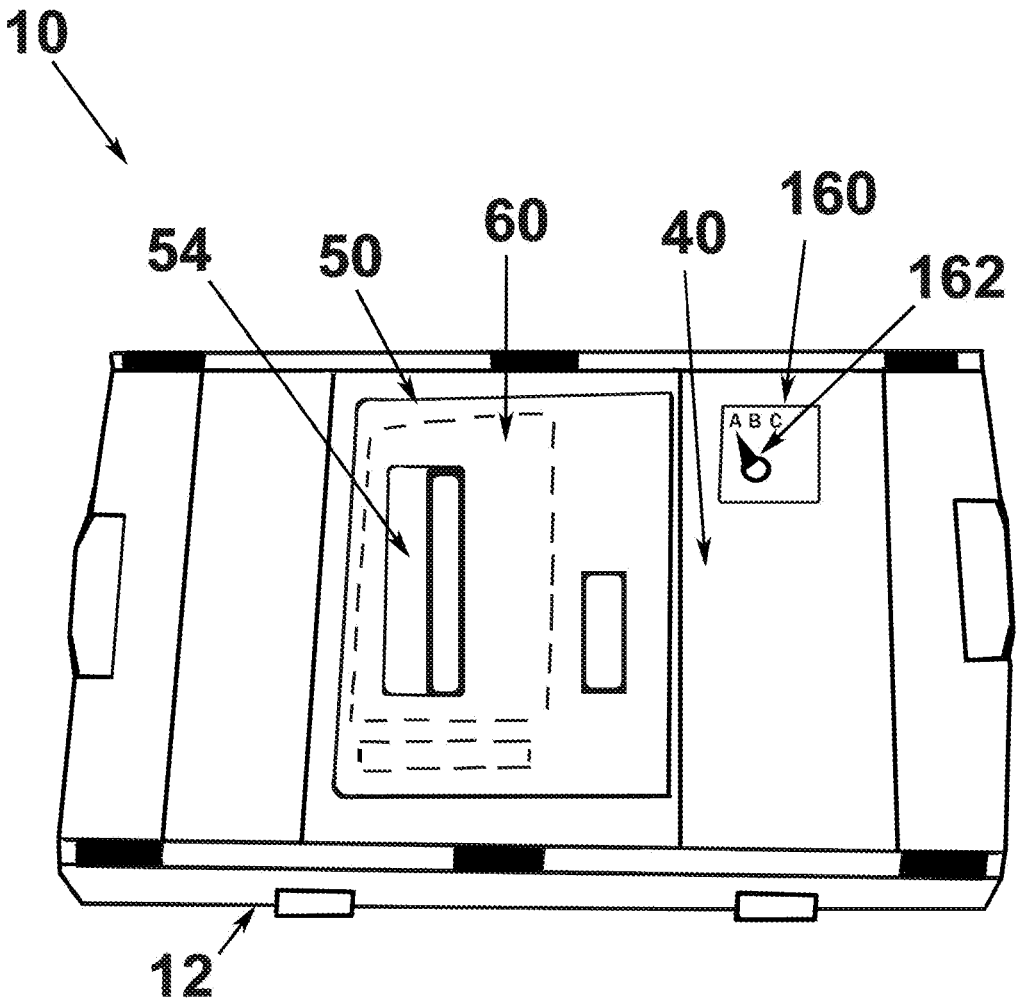
FIG. 6 is a top plan view of the portable shredder unit shown in FIG. 5.
Figure 7:
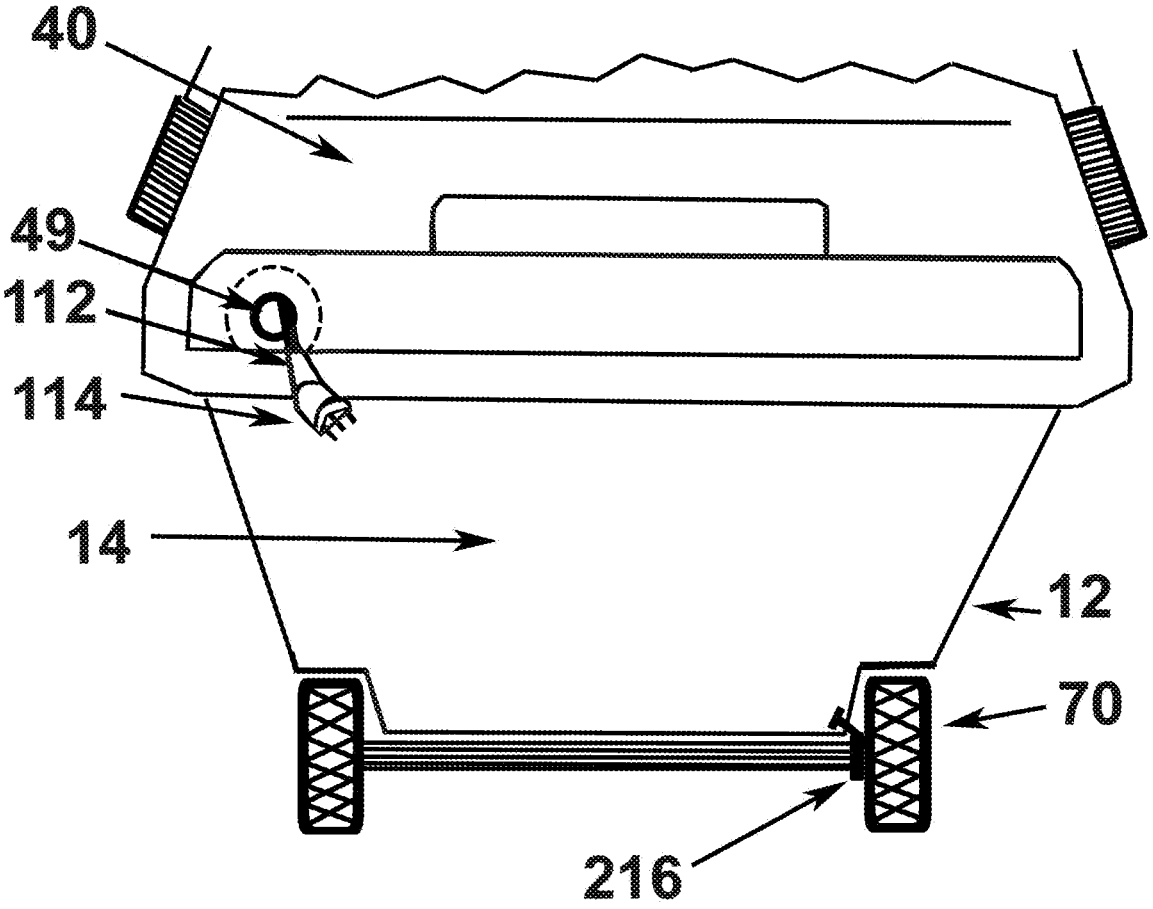
FIG. 7 is an end perspective view of the shredder unit shown in FIGS. 5 and 6.
Figure 8:
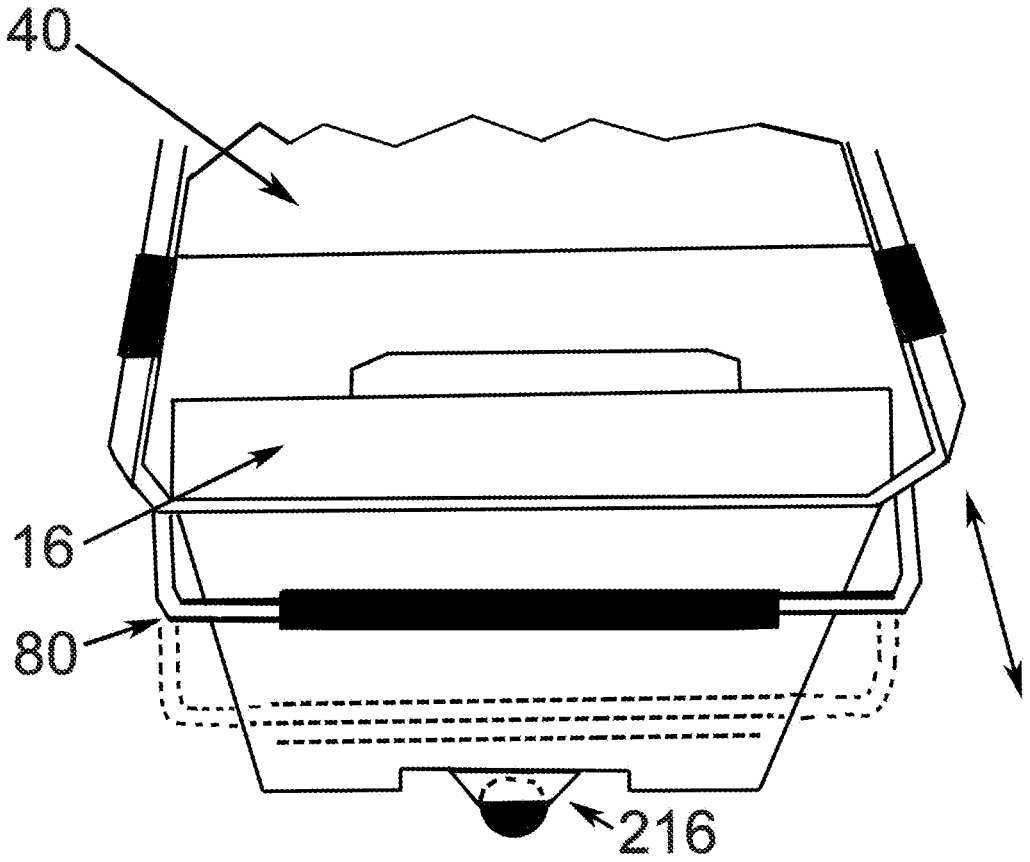
FIG. 8 is a perspective view showing the opposite end of the shredder unit shown in FIG. 7.
Figure 9:
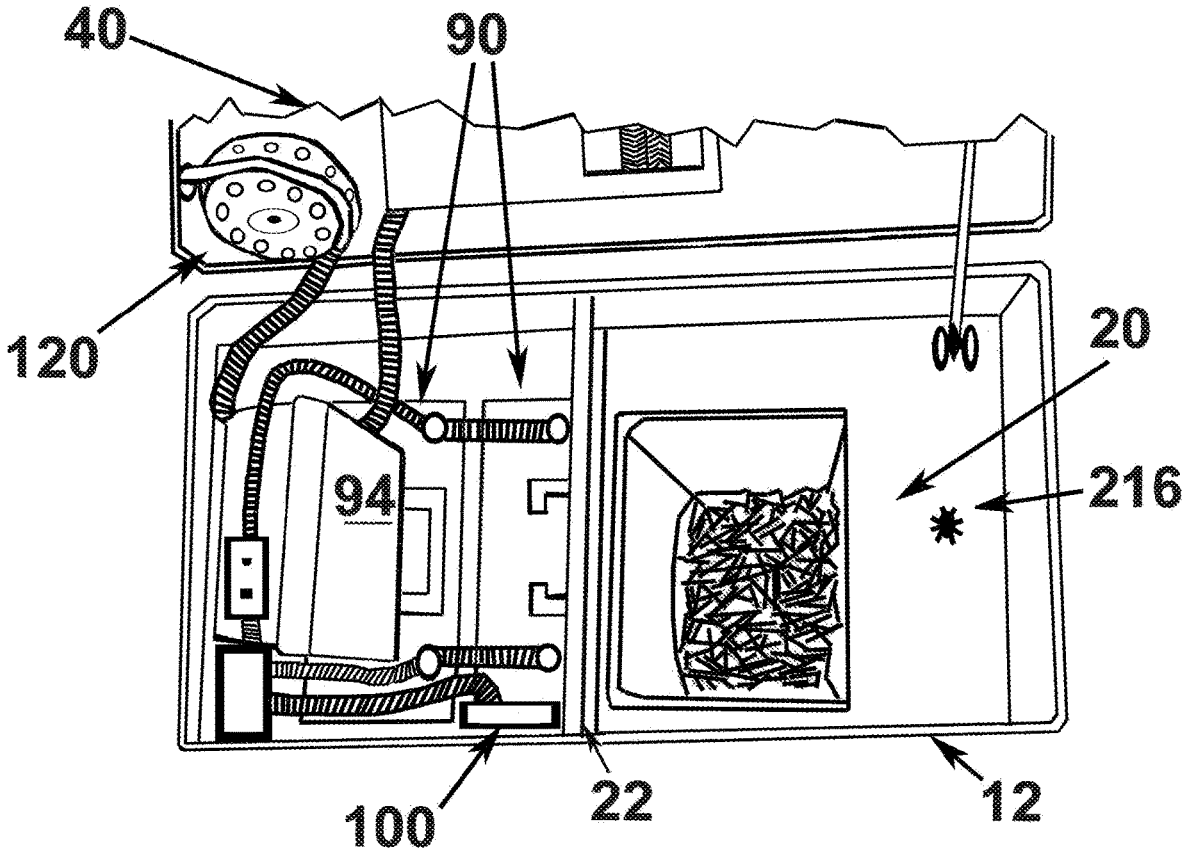
FIG. 9 is a top plan view of the shredder shown in FIG. 1 with the lid in an open position and showing the contents of the housing.
Figure 10:
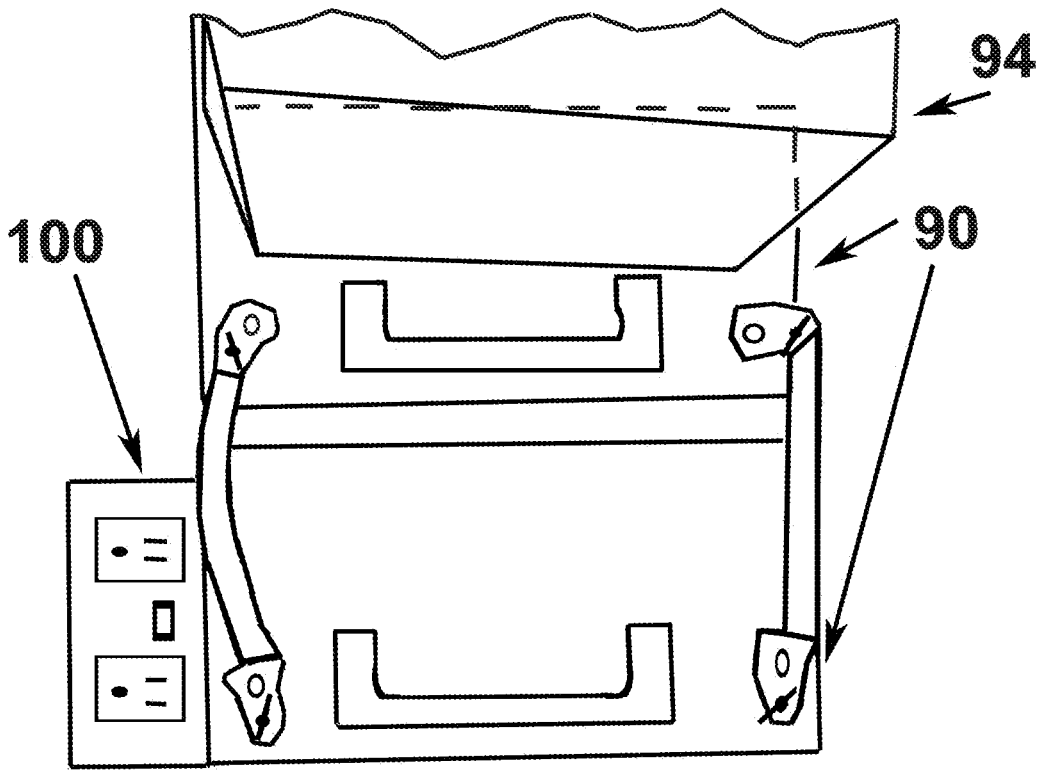
FIG. 10 is a partial top plan view of the two 12 DC volt batteries.
Figure 11:
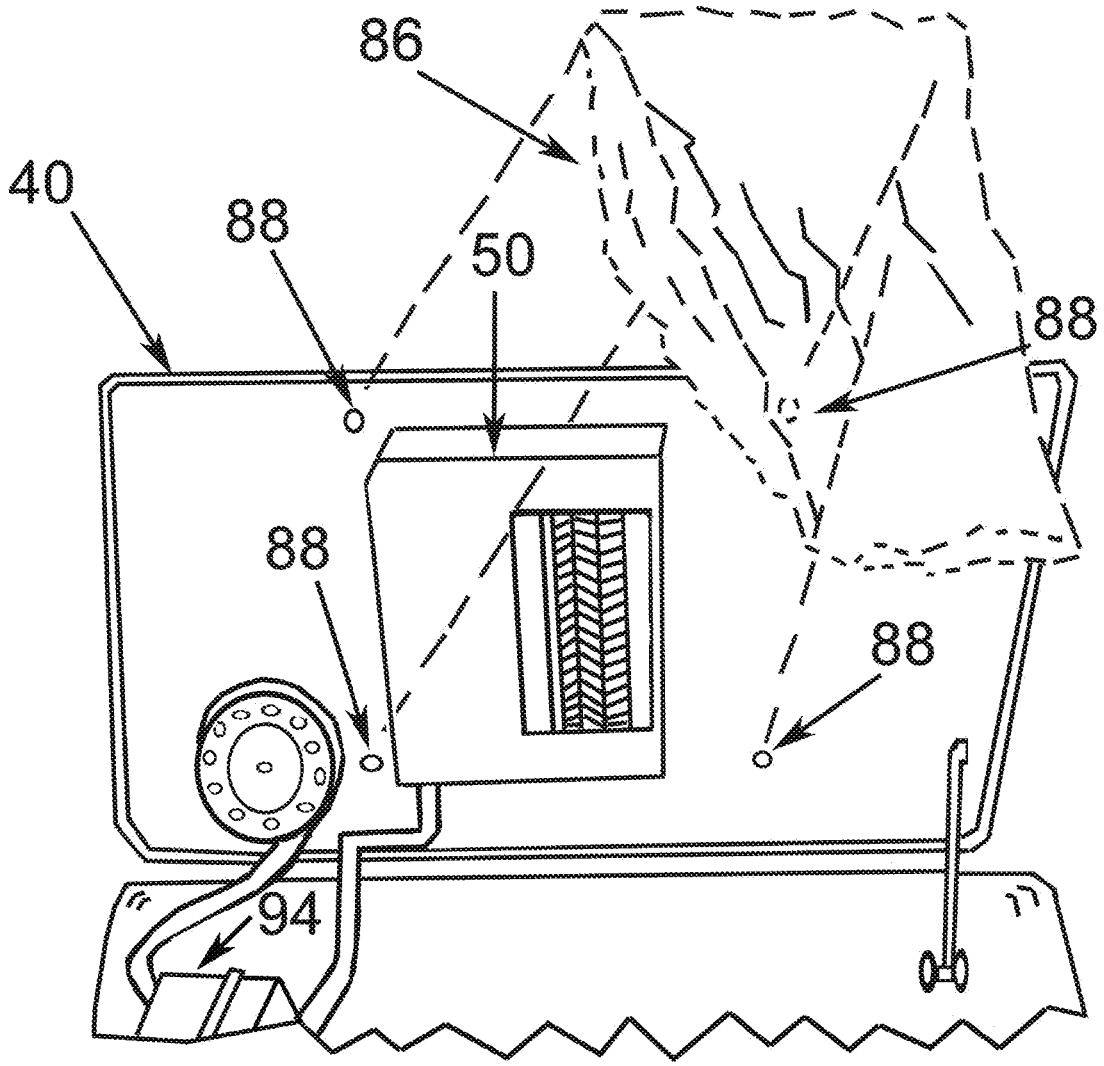
FIG. 11 is a side elevational view of the lid disposed in an open position over the housing showing the location of the electric shredder unit and the retractable windup spool that holds a long connector cord.

The housing 12 may include a standard, 110 VAC male electrical outlet 160 configured to connect to a 110 VAC standard female end plug connector on an extension cord 170 as shown in FIG. 4. The housing 12 may also include a GFCI breaker 156 for additional protection.

In the first aspect, the main electric cable 112 extends through an opening formed on the side of the housing 12. Attached to the end of the cable 112 is a standard three prong plug connector with ground wire 114 configure to plug into a standard 110 VAC electrical outlet 160. The cable 112 is wound onto a built-in automatic rewind real 120 located inside the housing 12.

As stated above, the first aspect of the shredder 10 is shown in FIGS. 1-4 has a housing 12 with a battery cavity 24 configured to house the one rechargeable battery 90. The battery charger, inverter and control panel are located in an ancillary housing. FIGS. 5-11 show a second aspect of the shredder 10 that uses a larger housing 12 that has a larger battery cavity 24 configured to hold one or more rechargeable batteries, the battery charger, and the invertor. The control panel 160 may be mounted inside the housing 12, on the partition, or mounted on, an external surface of the housing 12 or lid 40.

In the second aspect, the fixed lid 19 is eliminated and a modified removable long lid 40 is used that extends the entire length of the housing 12 and is attached via hinges 41 to the top edge of the housing 12. An optional adjustment rod 42 is provided that allows the user to set the lid 40 is a partial or full open position.

In the first aspect, a rewind reel 120 is mounted inside the housing 12. In the second aspect, a rewind reel 120 is mounted on the lid 40. The reel 120 is configured to allow the main cable 112 to be pulled from the housing and automatically rewinds main cable 112 into the housing 12 when desired. A wire hole 49 is formed on the end surface of housing 12 or the lid 40 that allows the main cable 112 to extend outside the lid 40.

In the first aspect, the housing 12 is rectangular with an interior cavity 20 configured to hold approximately 30 gallons. In the second aspect, the housing 12 is also rectangular with an interior cavity 20 configured to hold approximately 50 gallons.

The batteries are 12 volt DC maintenance free, ventless batteries. The inverter 100 is a 750 watt inverter and has a two female plugins 108 connected via a solid wire or alligator clips and a USB port 106. The battery charger 94 is a 12 volt DC battery charger connected to a GFCI receptacle 140 enclosed in a single gang electrical box. The shredder component 50 is a Compucessory Heavy Duty Cross-Cut shredder component (Model CCS60060) brand paper shredder component 50 designed to handle up to 30 sheets of paper, credit cards or CD/DVD discs. Other types of brands of shredder components may be used. The handle 80 is made of aluminum and extends approximately 15 to 20 inches from the end of the housing 12.

In one aspect, a plastic collection bin (not shown) may be placed in the collection cavity 30 to collect shredded material 6. In another aspect, an optional plastic bag 86 may be expanded and hung inside the collection cavity 30, so shredded material 6 falls directly therein. Hooks 88 may be mounted on the inside surface of the lid 40 that attach the corners of the bag 86 to the lid 40 to keep the bag 86 expanded and vertically aligned.

Figure 12:
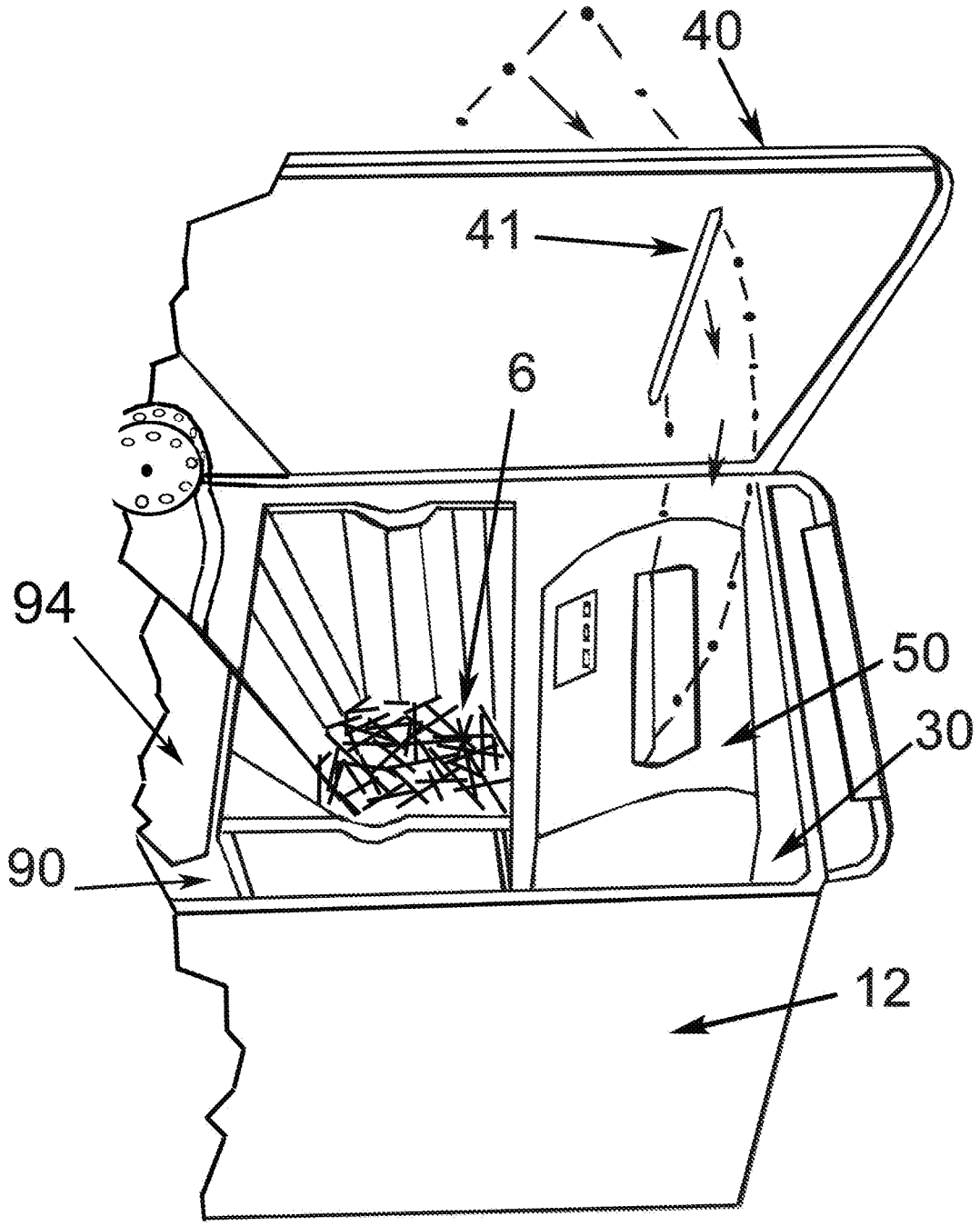
FIG. 12 is a partial top perspective showing the lid in an open configuration and showing the shredder component located inside the collection cavity formed in the housing with a slot formed on the lid that allows an operator to feed material into the feed slot opening on the shredder.

FIG. 12 is a partial top perspective showing the lid 40 in an open configuration and showing the shredder component 50 located inside the collection cavity 30 formed in the housing 12 with a slot 41 formed on the lid 40 that allows an operator to feed material into the feed slot opening on the shredder component 50.

Figure 13:
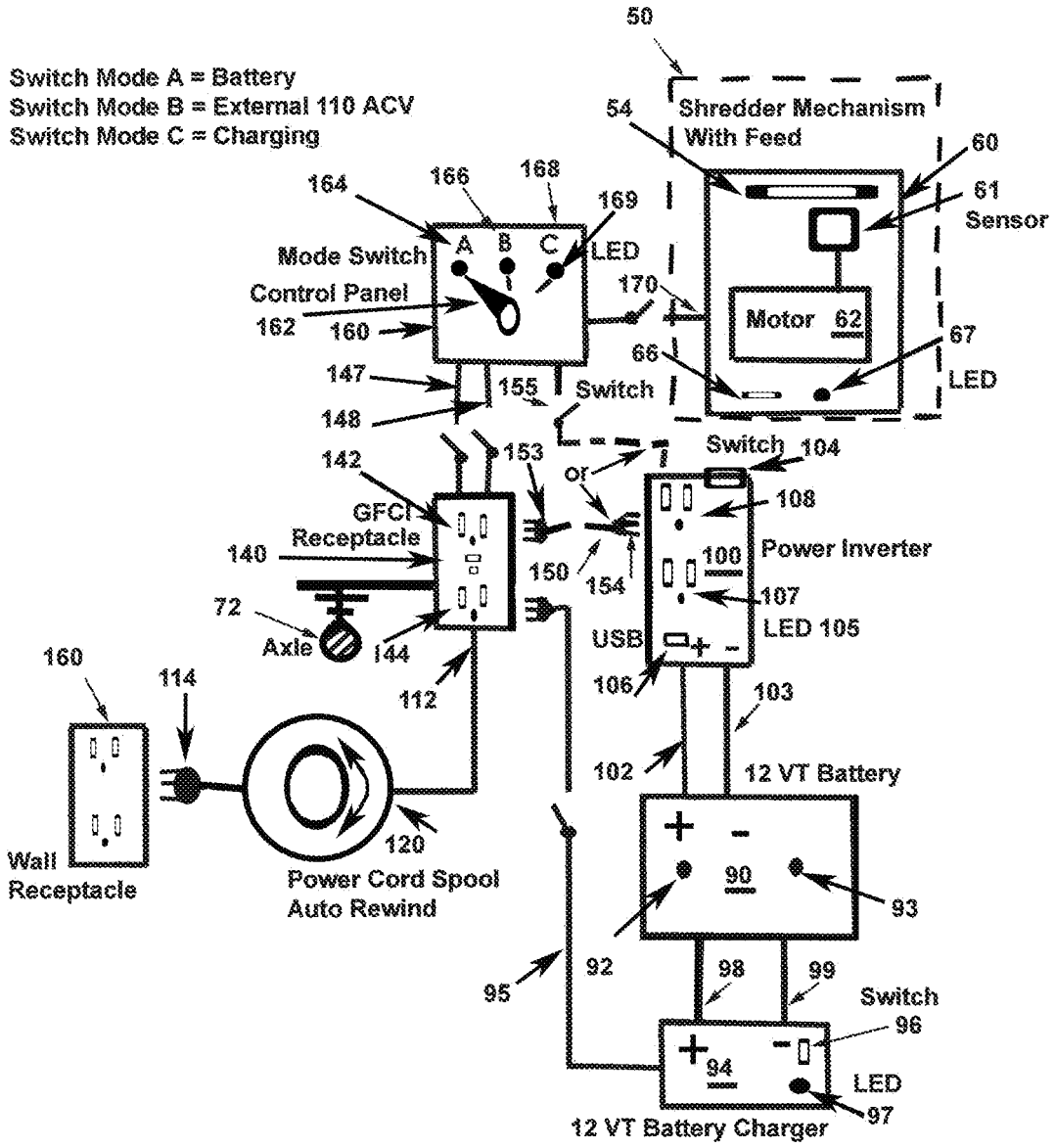
FIG. 13 is an illustration showing the electrical components connected together.

The control panel 160 is connected to the shredder component 50 and to the GFCI electrical outlet and the inverter 100 as shown in FIG. 13. The positive and negative cables 98, 99 on the battery charger 94 are connected via a solid wire or alligator clips to the positive and negative battery posts 92, 93, respectively. The positive and negative cables 102, 103 on the inverter 100 are also connected to the two battery posts 92, 93. The power cable 95 for the battery charger 94 is plugged into a female outlet plug 142 or 144 on the GFCI electrical outlet 140.

The unit 10 may have the inverter 100 directly connected to the control panel 160 via a direct cable 155 or it may be connected via the GFCI electrical outlet 140 via a first cable 147.

The operator then moves the mode switch 162 on the control panel 160 to one or three modes of operation; 'A', 'B' or 'C' positions, for battery operation; external 110 VAC operation; or battery charging operation, respectively.

When battery power operation is desired, the power switch 104 on the inverter 100 is moved to the 'ON' and the mode switch 162 is moved to the 'A' position 166. If the ancillary plug-in cable 150 is used, one male plug 153 is plugged into the female outlet receptacle on the GFCI electrical outlet 148 and the opposite male plug 154 is plugged into the female outlet receptacle 106 on the inverter 100. If the direct cable 155 is used, then electricity from the inverter 100 is delivered directly to the control panel 160. The external power switch 66 on the shredder component 50 is then activated and ready to shred paper, credit cards, or disc deposited into the feeding slot 54. When the plug-in cable 150 is used, electricity from the GFCI electrical outlet 140 is delivered to the control panel 160 via a first cable 147. When the mode switch 162 is moved to the 'A' position 164, electricity from the second cable 148, discussed further below is disconnected.

When external 110 VAC operation is desired, then the mode switch 162 is moved to the 'ON' position 166 and the male plug 114 is plugged into the external 110 VAC electrical outlet 160. The power switch 66 on the shredder component 50 is then activated and ready to shred paper, credit cards, or disc deposited into the feeding slot 54. When the mode switch 162 is moved to the 'B' position 166, electricity from the inverter 100 is automatically discontinued. Electricity flows from the GFCI electrical outlet 140 through the second cable 148 to the control panel 160

When battery charging is desired, the mode switch 162 is moved to the 'C' position 168. The power switch 96 on the battery charger 94 is then moved to the 'ON' position. Electricity from the inverter 100 and from the GFCI electrical outlet 140 are disconnected.

Cables 147, 148 and 170 and power cords 95 may include separate fuses.

Figure 14:
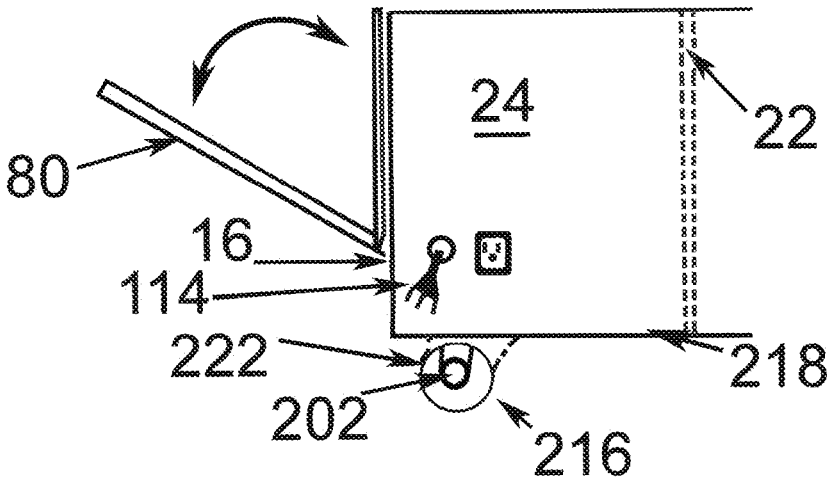
FIG. 14 illustrate an alternative configuration for the front end of the portable shredder.

FIG. 14 illustrate an additional aspect, showing an alternative configuration for the front end of the portable shredder. As shown in FIG. 14 the pair of vertical legs that elevate and support the front portion of the housing have been replaced with wheels, a first wheel 202 together with a second wheel (hidden from view, not illustrated).

Figure 15:
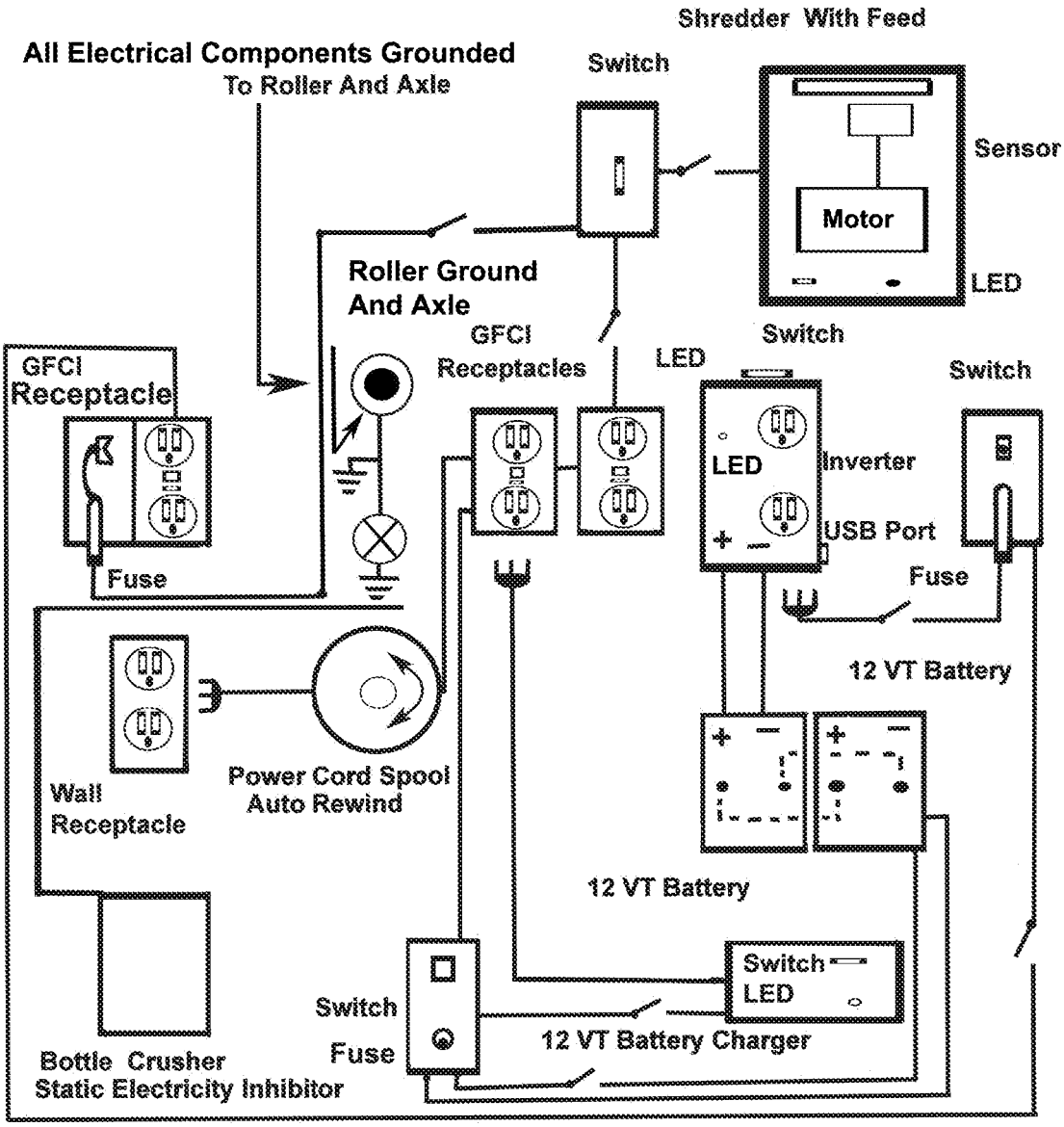
FIG. 15 illustrates an alternative schematic or the portable shredder unit with different electrical connections.

FIG. 15 illustrates an alternative schematic for the portable shredder unit.

Figure 16:
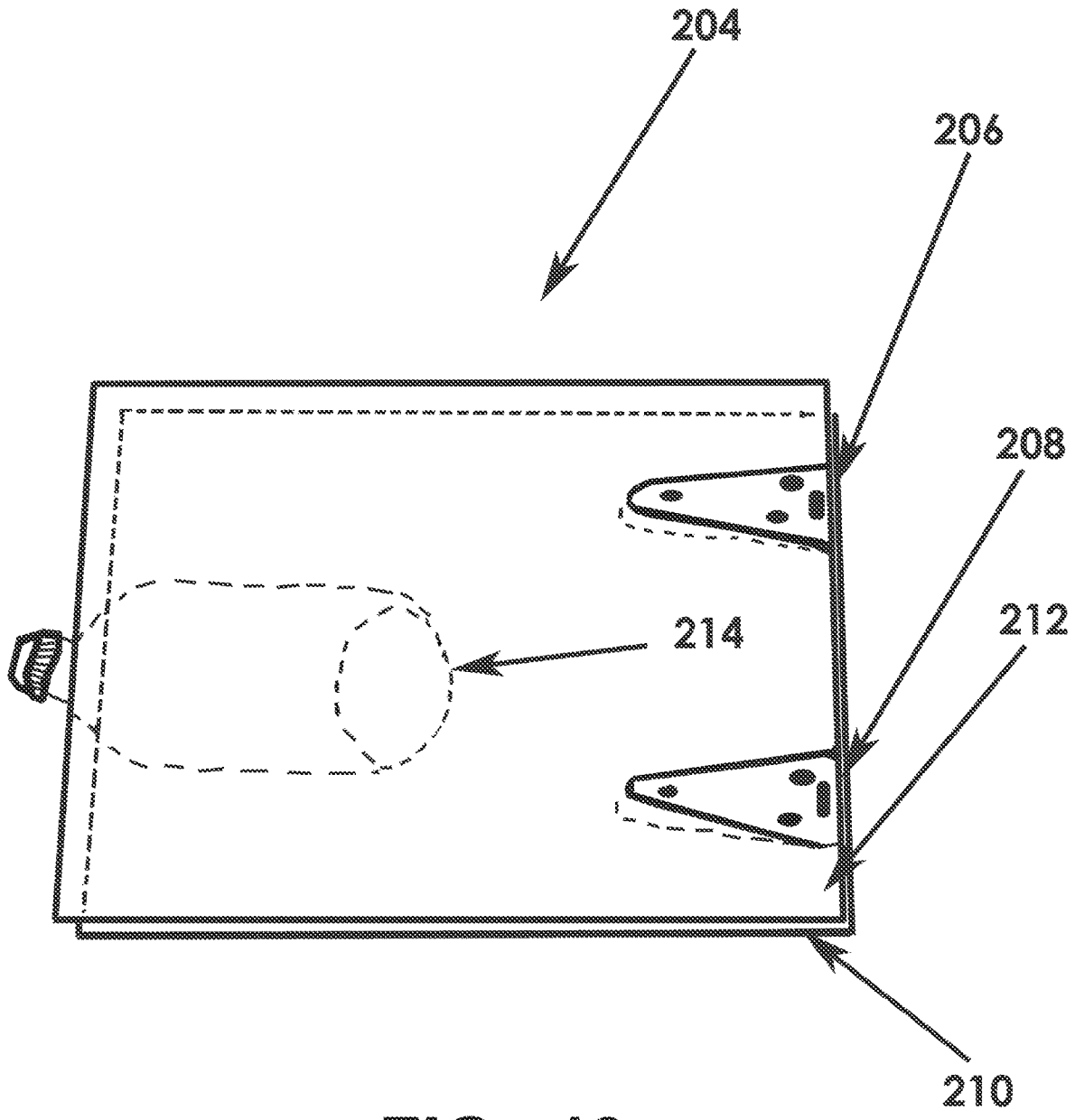
FIG. 16 illustrates a bottle crusher.

FIG. 16 illustrates an optional bottle crusher, 204. The bottle crusher may be connected via an electrical wire to the ground of the portable shredder to discharge any static electricity. The bottle crusher may also be stored within the housing. The bottle crusher includes a bottom leaf 210 opposite a top leaf 212, which are attached via hinges 206 and 208. Preferably, the bottom and top leaves are made of a hard plastic material, such as polycarbonate, and the hinges are preferably metal. As illustrated, a plastic bottle 214, preferably a polyethylene bottle, may be placed between bottom and top leaves and then crushed flat by application of pressure, such as by a user's foot or hand. The flattened bottle may then be shredded, because it will now fit into the feed slot. In this way, a large number of plastic bottles may be shredded with the portable shredder unit, greatly reducing the volume of the plastic, such as polyethylene, and reducing the cost of transport for recycling. Any static electricity which could build up from the shredding of the plastic bottle or handling of the shredded polyethylene is discharged by an electrical connection to the electrical ground. Such charge may build up on the shredder component, storage bin, or other parts which come into contact with the plastic of the bottles or the shredded polyethylene.

Figure 17:
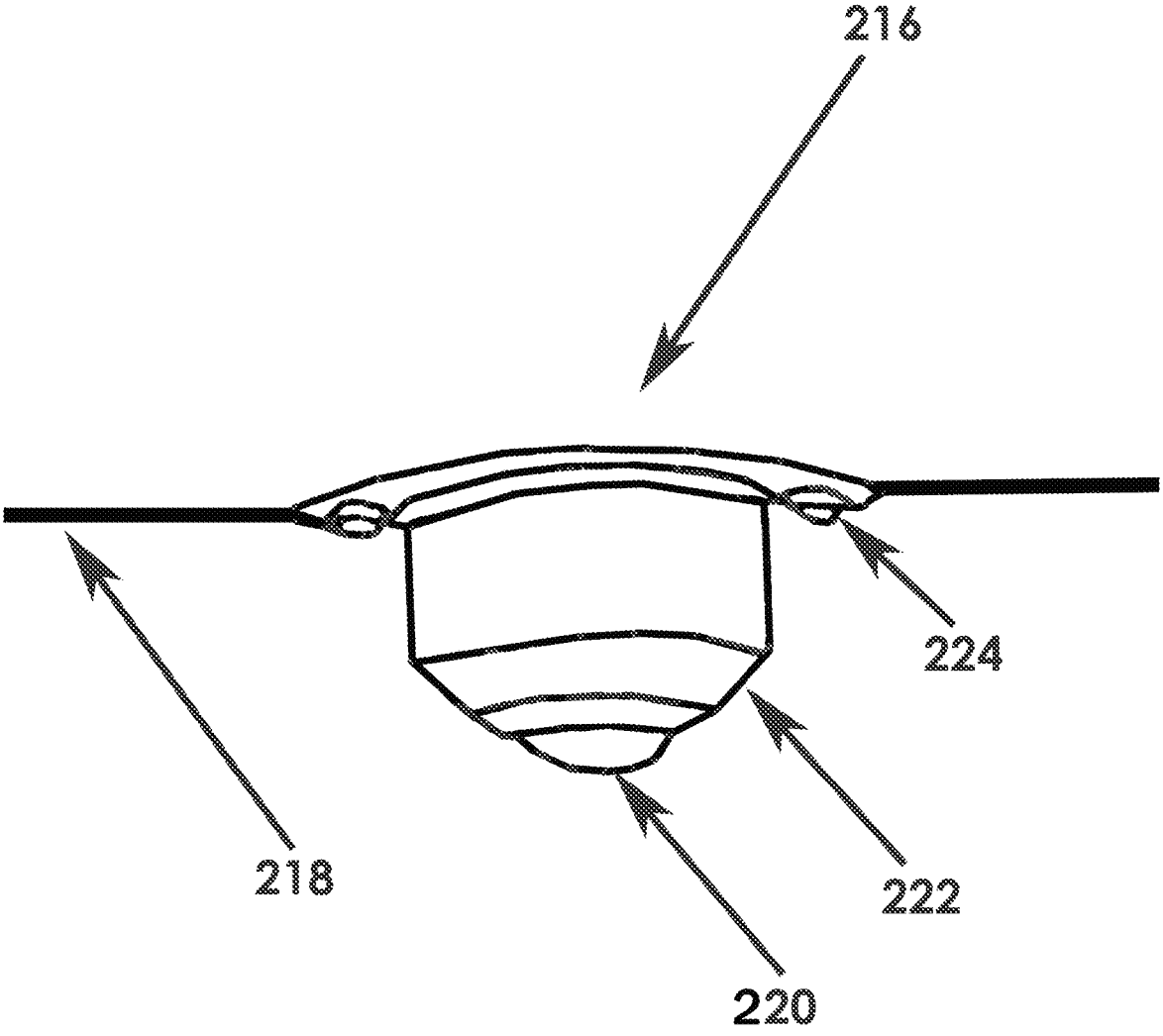
FIG. 17 illustrates an optional ground roller ball.
Figure 18:
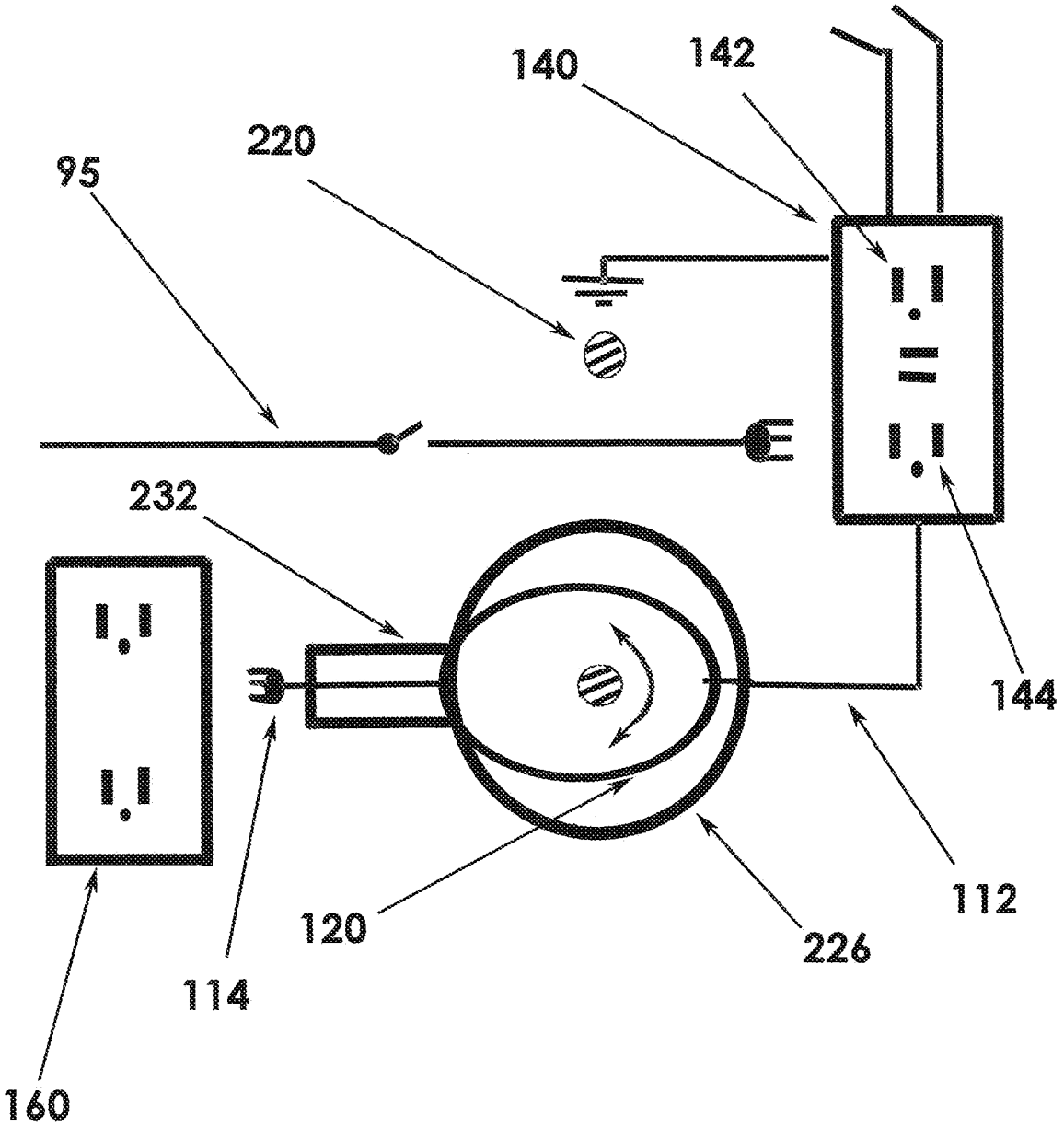
FIG. 18 shows a portion of the FIG. 13, where the ground roller ball is electrically connected to ground.

FIG. 17 illustrates an optional ground roller ball, 216. The ground roller ball is attached to the underside 218 of the housing. The ground roller ball includes a metal roller ball 220, which is preferably made from stainless steel, a ball housing 222 and an attachment collar 224 for attaching the housing to the underside of the housing. The ground roller ball is used as an electrical ground, and is electrically connected the ground of the various GFCI electrical outlets. In use, the ground roller ball is in contact with the surface under the portable shredder unit, allowing any accumulated charge to discharge to soil. FIG. 18 shows a portion of the FIG. 13, with the ground roller ball illustrated as being electrically connected to ground. Also illustrated in FIG. 18 is an optional cover 226 for the rewind reel 120, which is preferably made of metal and grounded. Furthermore, a plug cover 232, which prevents any person or object from hitting or damaging the plug 114, may also be included and is preferably made from a soft material, such as neoprene. The ground roller ball may be used alone, or also with the ground connected to the axle.

Figure 19:
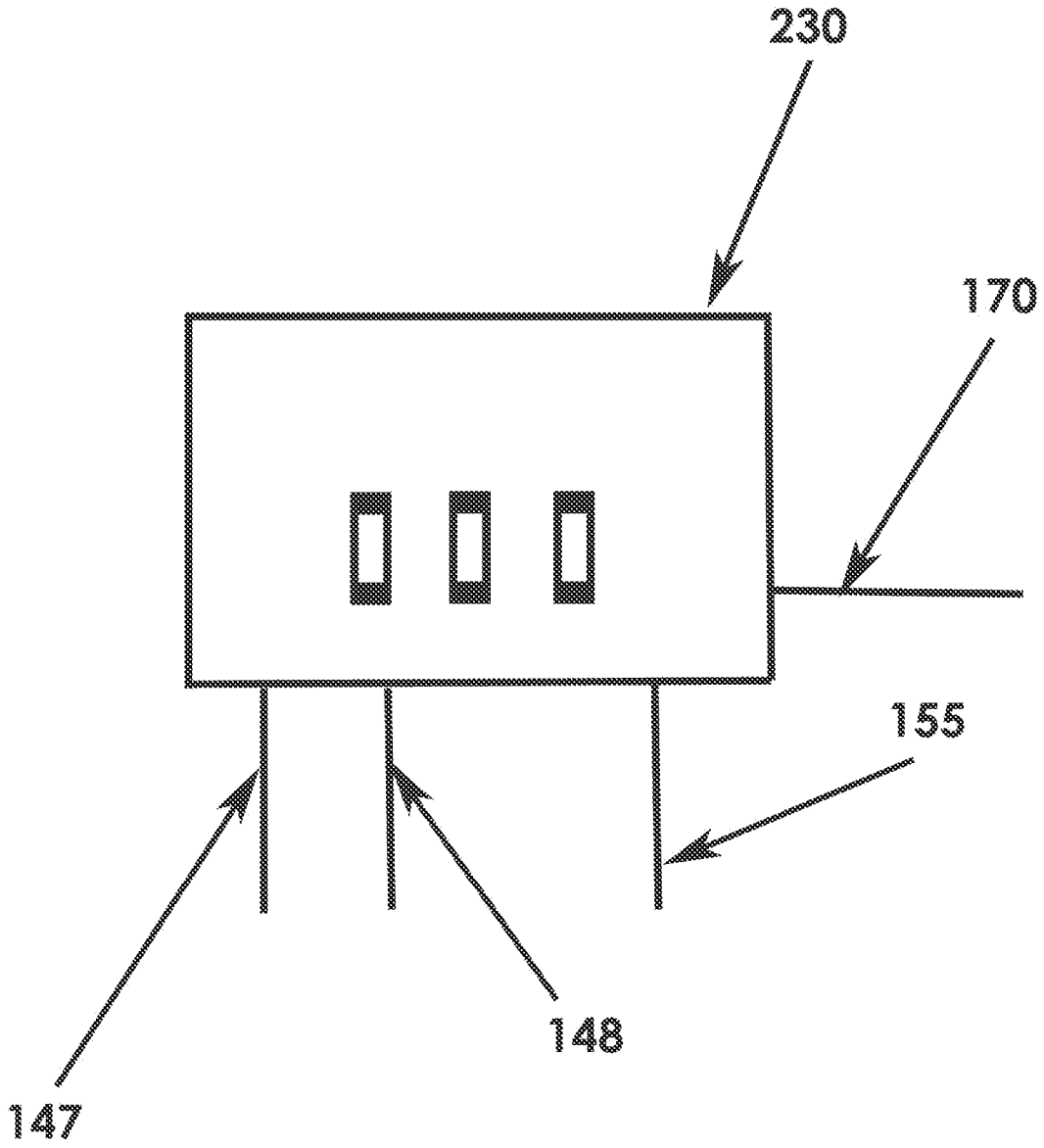
FIG. 19 illustrates an alternate aspect of a small portion of FIG. 13, where the control panel is replaced with a set of switches

FIG. 19 illustrates a small portion of FIG. 13, where the control panel shown in FIG. 13 is replaced with a set of switches 230. In this alterative aspect, the set of switches allows replacement of the control panel, which may be delicate and not sufficiently robust for extended use outdoors, with simple switches which are much more durable. By turning different switches on or off, the user may select powering the device from municipal power via a wall outlet, the internal batteries or choose to recharge the internal batteries.

In compliance with the statute, the invention described has been described in language more or less specific on structural features. It should be understood, however, that the invention is not limited to the specific features shown, since the means and construction shown comprises the preferred aspects for putting the invention into effect. The invention is therefore claimed in its forms or modifications within the legitimate and valid scope of the amended claims, appropriately interpreted the doctrine of equivalents.

What is claimed is:

1. A portable shredder unit 10 comprising:

a. a lightweight housing 12 with an interior cavity 20 divided into a battery storage cavity 24 and a collection cavity 30, said lightweight housing 12 includes a top opening 13, two opposite ends 14, 16, two opposite side walls 15, 17, and a floor 18;

b. a removable lid 40 attached to said top opening 13 on said lightweight housing 12;

c. a high capacity electric shredder component 50 configured to shred paper, said high capacity electric shredder component 50 includes at least one feeding slot opening 54, an electric shredding mechanism 60, and electric motor 62 and an exit discharge opening 65, said high capacity electric shredder component 50 being oriented on said removable lid 40 so that said feeding slot opening 54 is exposed when the removable lid 40 is placed over the top opening 13 of said lightweight housing 12 and said exit discharge opening 65 is oriented above and over said collection cavity 30 in said lightweight housing 12 so that shredded material exiting the exit discharge opening 65 is deposited into said collection cavity 30;

d. at least one pair of wheels 70 attached to said lightweight housing 12 near one said end 14;

e. a handle 80 attached to said lightweight housing 12;

f. a GFCI receptacle having a ground wire;

g. a 110 VAC main cable 112 with a male electrical plug 114 attached to one end configured to manually plug into an external 110 VAC female plug, and an opposite end being connected to said GFCI receptacle;

h. at least one 12 VDC rechargeable battery 90 located inside said battery storage cavity 24;

i. an inverter 100 configured to convert 12 VDC into 110 VAC, said inverter 100 connected to said 12 VDC rechargeable battery 90 to convert 12 VDC current into 110 VAC;

j. a control panel 160 or set of switches 230 electrically connected to said high capacity electric shredder component, to said inverter and to said GFCI receptacle, said control panel or set of switches are configured to allow an operator to select the source of electricity either from said GFCI receptacle 140 when said 110 VAC main cable 112 is connected to an external 110 VAC female plug 160 or from said inverter 100 when connected to said 12 VDC rechargeable battery 90; and k. a ground roller ball 216 attached to the floor of the lightweight housing and configured to contact a surface under the lightweight housing when the portable shredder unit is placed onto the surface, said ground roller ball electrically connected to the ground wire of said GFCI receptacle.

2. The portable shredder unit, as recited in claim 1, wherein said high capacity electric shredder component 50 is mounted on said removable lid 40.

3. The portable shredder unit, as recited in claim 1, wherein said handle 80 is configured to retract and extend from said lightweight housing 12.

4. The portable shredder unit, as recited in claim 1, further including a reel rewind spool 120 configured to automatically rewind said 110 VAC main cable 112 onto said reel rewind spool 120 and allow said 110 VAC main cable 112 to be selectively unwound therefrom.

5. The portable shredder unit, as recited in claim 3, wherein said reel rewind spool 120 is located inside the lightweight housing.

6. The portable shredder unit, as recited in claim 1, further including a vertical partition 22 transversely aligned inside said lightweight housing 12 and between the battery storage cavity 24 and the collection cavity 30.

7. The portable shredder unit, as recited in claim 1, further including a removable plastic bag 86 hung in said collection cavity 30 to collect shredder material from said high capacity electric shredder component 50.

8. The portable shredder unit, as recited in claim 1, wherein said inverter 100 includes at least one female outlet 108 and a dual male plug cable 150 configured to plug into said female outlet 108 in said inverter 100 and plug into a female outlet 144 on said GFCI receptacle 140.

9. The portable shredder unit, as recited in claim 1, further including a 12 Volt battery charger 94 configured to charge said 12 VDC rechargeable battery 90.

10. The portable shredder unit, as recited in claim 9, wherein said 12 Volt battery charger 94 includes a power cable 95 with a male plug that connects to a female outlet 144 on said GFCI receptacle 140.

11. The portable shredder unit, as recited in claim 10, wherein said control panel 160 or set of switches 230 are configured for selecting said 12 VDC rechargeable battery 90 to be charged by said 12 Volt battery charger 94 and disconnect said high capacity electric shredder component 50 from said 110 VAC female plug 160 and disconnects said high capacity electric shredder component 50 from said inverter 100.

12. The portable shredder unit, as recited in claim 3, further including a 12 Volt battery charger 94 configured to charge said 12 VDC rechargeable battery 90.

13. The portable shredder unit, as recited in claim 12, wherein said 12 Volt battery charger 94 includes a power cable 95 with a male plug that connects to a female outlet 144 on said GFCI receptacle 140.

14. The portable shredder unit, as recited in claim 13, wherein said control panel 160 or set of switches 230 are configured for selecting said 12 VDC rechargeable battery 90 to be charged by said 12 Volt battery charger 94 and disconnect said high capacity electric shredder component 50 from said 110 VAC female plug 160 and disconnects said high capacity electric shredder component 50 from said inverter 100.

15. The portable shredder unit, as recited in claim 12, wherein said inverter 100 includes at least one female outlet 108 and a dual male plug cable 150 configured to plug into said female outlet 108 in said inverter 100 and plug into a female outlet 144 on said GFCI receptacle 140.

16. The portable shredder unit, as recited in claim 15, wherein said reel rewind spool 120 is located in said removable lid 40.

17. The portable shredder unit, as recited in claim 16, further including a vertical partition 22 transversely aligned inside said lightweight housing 12 and between the battery shortage cavity 24 and the collection cavity 30.

18. The portable shredder unit, as recited in claim 1, wherein said handle 80 is pivotally attached to the lightweight housing 12.

19. The portable shredder unit, as recited in claim 1, further comprising a bottle crusher 204 electrically connected to the ground wire of said GFCI receptacle for discharging static electricity.

20. A method of shredding plastic bottles with the portable shredder unit of claim 1, comprising:

crushing a plastic bottle, and shredding the plastic bottle with the high capacity electric shredder.

* * * * *